US009609443B2

(12) United States Patent
Ruaro et al.

(10) Patent No.: US 9,609,443 B2
(45) Date of Patent: Mar. 28, 2017

(54) IN-THE-EAR HEARING AID HAVING COMBINED ANTENNAS

(71) Applicant: GN ReSound A/S, Ballerup (DK)

(72) Inventors: Andrea Ruaro, Copenhagen NV (DK); Brian Jeppesen, Frederiksberg (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/805,937

(22) Filed: Jul. 22, 2015

(65) Prior Publication Data

US 2017/0026762 A1 Jan. 26, 2017

(30) Foreign Application Priority Data

Jul. 21, 2015 (DK) ..... 2015 70485
Jul. 21, 2015 (EP) ..... 15177659

(51) Int. Cl.
*H04R 25/00* (2006.01)

(52) U.S. Cl.
CPC ..... *H04R 25/554* (2013.01); *H04R 2225/025* (2013.01); *H04R 2225/51* (2013.01)

(58) Field of Classification Search
CPC .. H04R 25/554; H04R 25/55; H04R 2225/00; H04R 2460/00; H01Q 7/00; H01Q 1/00; H01Q 9/00
USPC ..... 381/315, 324
See application file for complete search history.

(56) References Cited

U.S. PATENT DOCUMENTS

2006/0093174 A1 5/2006 Niederdrank et al.
2008/0232624 A1 9/2008 Gebhardt et al.
2009/0315787 A1* 12/2009 Schatzle ..... H01Q 1/273 343/702
2010/0158295 A1 6/2010 Polinske et al.
2012/0002830 A1 1/2012 Solum

FOREIGN PATENT DOCUMENTS

EP 1 719 384 11/2006
EP 2 200 119 A2 6/2010
EP 2 200 119 A3 6/2011
(Continued)

OTHER PUBLICATIONS

Extended European Search Report dated Dec. 1, 2015 for corresponding EP Patent Application No. 15177659.8, 9 pages.
(Continued)

*Primary Examiner* — Sunita Joshi
(74) *Attorney, Agent, or Firm* — Vista IP Law Group, LLP

(57) ABSTRACT

An in-the-ear hearing aid having a first end and a second end, includes: a microphone; a printed circuit board; a receiver; a battery having a first side and a second side, where the battery is located at the second end; one or more wireless communication units; a first antenna interconnected with one of the one or more wireless communication units, wherein the first antenna is located at the second end; and a second antenna located at the second end, wherein the second antenna is located closer to the second side of the battery than the first side; wherein the printed circuit board is located closer to the first side of the battery than the second side; and wherein the first antenna is fed from the printed circuit board, and comprises an antenna part that is located closer to the second side of the battery than the first side.

16 Claims, 5 Drawing Sheets

(56) References Cited

FOREIGN PATENT DOCUMENTS

| | | | |
|---|---|---|---|
| JP | H05 83173 | A | 4/1993 |
| JP | 2007 306147 | A | 11/2007 |
| WO | WO 2005/081583 | A1 | 9/2005 |
| WO | WO 2005/081583 | A1 | 9/2005 |
| WO | WO 2014/086392 | A1 | 6/2014 |

OTHER PUBLICATIONS

First Technical Examination and Search Report dated Mar. 23, 2016 for corresponding U.S. Patent Application No. PA 2015 70485, 5 pages.

* cited by examiner

IN-THE-EAR HEARING AID HAVING COMBINED ANTENNAS

RELATED APPLICATION DATA

This application claims priority to and the benefit of Danish Patent Application No. PA 2015 70485 filed Jul. 21, 2015, pending, and European Patent Application No. 15177659.8 filed Jul. 21, 2015, pending. The entire disclosures of both of the above applications are expressly incorporated by reference herein.

FIELD

The present disclosure relates to antennas for hearing aids, in particular the present disclosure relates to hearing aids having two or more antennas, such as for example to a hearing aid having a combination of an electrical antenna and a magnetic antenna. The hearing aid may be used in a binaural hearing aid system. During operation, the hearing aid is worn in the ear of a user.

BACKGROUND

Hearing aids are very small and delicate devices and comprise many electronic and metallic components contained in a housing or shell small enough to fit in the ear canal of a human or be located behind the outer ear. The many electronic and metallic components in combination with the small size of the hearing aid housing or shell impose high design constraints on radio frequency antennas to be used in hearing aids with wireless communication capabilities.

Moreover, the antenna in the hearing aid has to be designed to achieve a satisfactory performance despite these limitations and other high design constraints imposed by the size of the hearing aid.

Still further, in binaural hearing aid systems, the requirements to the quality of the communication between the hearing aids in the binaural hearing aid system are ever increasing, and include demands for low latency and low noise, increasing the requests for effective antennas in the hearing aids.

SUMMARY

It is an object to provide a hearing aid with improved wireless communication capabilities, such as improved wireless communication capabilities between two hearing aids worn in opposite ears of the user, and/or between a hearing aid and an accessory device.

In accordance with some embodiments described herein, the above-mentioned and other objects are obtained by an in-the-ear hearing aid, the hearing aid having a first end and a second end. The hearing aid comprises a microphone configured to receive an audio signal. The hearing aid comprises a printed circuit board comprising a processing unit configured to process the audio signal for compensating a hearing loss of a user. The hearing aid comprises a receiver configured to transmit the processed audio signal. The hearing aid comprises a battery having a first side and a second side. The battery may be provided at the second end of the hearing aid. The hearing aid comprises one or more wireless communication units for wireless communication. The hearing aid comprises a first antenna for emission and/or reception of an electromagnetic field being interconnected with one of the one or more wireless communication units. The first antenna is provided at the second end of the hearing aid. The hearing aid comprises a second antenna for emission and/or reception of an electromagnetic field being interconnected with one of the one or more wireless communication units. The second antenna is provided at the second end of the hearing aid. The second antenna is provided at the second side of the battery. The printed circuit board is provided at the first side of the battery. The first antenna is fed from the printed circuit board at the first side of the battery and extends to the second side of the battery.

It is an advantage of the hearing aid that a first antenna and a second antenna is provided in the hearing aid shell, increasing the wireless communication capabilities of the hearing aid.

It is a further advantage that the electrical field from the first, e.g. electric, antenna does not affect or influence or disturb the electromagnetic field from the second, e.g. magnetic, antenna, and thus no shielding between the first antenna and the second antenna is required. The reason why the first and the second antenna do not disturb each other's fields, e.g. electromagnetic fields, is because of the arrangement of the two antennas relative to each other. The first antenna may have a low magnetic field at its second end, e.g. the second end may be an open end, which is close to the second antenna, and thus the first antenna does not disturb the electromagnetic field of the second antenna.

It is an advantage that the hearing aid is capable of streaming audio, such as music from a music player, sound from a television etc. The streaming of audio may be ear-to-ear streaming by means of the second antenna, which may be a magnetic antenna. The second, e.g. magnetic, antenna of the hearing aid may point towards a corresponding second, e.g. magnetic, antenna, of another hearing aid in a binaural hearing aid system.

It is an advantage that the second antenna may use less electric power, thus the battery life may be increased due to the use of the second antenna.

The receiver may be provided at the first end of the hearing aid. Thus the receiver and the second antenna may be provided in different ends of the hearing aid. Thus it is an advantage that the distance between the receiver and the second antenna is large, or as large as possible, or relatively large, e.g. compared to other hearing aid shells, because then receiver may not provide noise or may provide less noise in the second antenna and/or vice versa that the second, e.g. magnetic, antenna may not provide noise or may provide less noise in the receiver, due to the absence of intersecting magnetic fields or the weak intersecting magnetic fields of the receiver and the second, e.g. magnetic, antenna.

Thus it is a further advantage that when the receiver and the second antenna are arranged in opposite ends of the hearing aid, i.e. with a distance to each other, the receiver may not need to be shielded from the second antenna by e.g. the battery. This allows for more options and flexibility for the relative arrangement of the components, e.g. components with magnetic or electromagnetic fields, e.g. the receiver and the second antenna.

It is an advantage that the processing unit on the printed circuit board is shielded, e.g. magnetically, from the second antenna by the battery, since the second antenna is provided on the second side of the battery and the printed circuit board with the processing unit is provided on the first side of the battery. The second antenna would otherwise magnetically disturb the processing unit and/or vice versa, that the processing unit would magnetically disturb the second antenna.

It is an advantage that the first, e.g. electric, antenna is fed from or has its feed point or has its connection to the transmission line at the first side of the battery, since hereby the field from the first antenna, e.g. the electric and/or magnetic and/or electromagnetic field, is largest at the first side of the battery. When the second, e.g. magnetic, antenna is provided at the second side of the battery, then the shadow effect of the battery reduces interference between the first antenna and the second antenna.

According to a further aspect, a binaural hearing aid system is disclosed comprising a first and a second hearing aid as herein disclosed. Thus the first and/or second hearing aid may be a hearing aid as disclosed above.

The first antenna may be configured for radiation in a first frequency range, and the second antenna may be configured for radiation in a second frequency range.

In one or more embodiments, the hearing aid comprises hearing aid electronic components including the signal processor. The hearing aid electronic components may be provided on a printed circuit board, and typically, the hearing aid electronic components are provided on the first side of the battery. Hereby, the battery provides shielding for the second antenna, which is provided on the second side of the battery, with respect to any noise caused by the first antenna and/or the hearing aid electronic components. Thus, the battery may act as a shielding element for the second antenna.

The battery may be a flat battery, such as a button shaped battery. The battery may be circular. The battery may be a disk-shaped battery.

The hearing aid may be any hearing aid, such as a hearing aid of the in-the-ear type, such as in-the-canal type, such as completely-in-the-canal type of hearing aid, etc., a hearing aid of the behind-the-ear type, of the receiver-in-the-ear type of hearing aid, etc.

The hearing aid typically comprises a shell, such as a polymer or plastic shell, in a shape configured to be provided in the ear, in the ear-canal or completely-in-the-canal of the ear of a user. The shell of an in-the-ear having aid may comprise a first end at the first end of the hearing aid and a second end at the second end of the hearing aid. The shell may comprise a faceplate in the second end of the shell. The faceplate is a plate or cover closing the second end of the hearing aid shell. The hearing aid shell may be open in the second end and thus the faceplate provides a closing of the hearing aid shell. The faceplate may comprise one or components of the hearing aid. The faceplate may comprise a battery door. The faceplate may be detachable or removable from the hearing aid shell, e.g. for the purpose of changing the battery and/or replacing or repairing other components in the hearing aid shell.

The one or more wireless communications unit(s) are configured for wireless data communication, and in this respect interconnected with the first and/or second antenna for emission and reception of an electromagnetic field. Each of the one or more wireless communication unit may comprise a transmitter, a receiver, a transmitter-receiver pair, such as a transceiver, a radio unit, etc. The one or more wireless communication units may be configured for communication using any protocol as known for a person skilled in the art, including Bluetooth, WLAN standards, manufacture specific protocols, such as tailored proximity antenna protocols, such as proprietary protocols, such as low-power wireless communication protocols, RF communication protocols, magnetic induction protocols, etc. The one or more wireless communication units may be configured for communication using same communication protocols, or same type of communication protocols, or the one or more wireless communication units may be configured for communication using different communication protocols.

In one or more embodiment the first antenna is fed from the printed circuit board at a first end of the antenna, and the first antenna comprises a second end.

In one or more embodiments the second end of the first antenna is open. It is an advantage that the second end of the first antenna is open or open-circuited or free or not connected since this provides a high resistance or impedance at the second end of the first antenna and thus the current is zero or low at the second end of the first antenna. This provides the advantage that the second end of the first antenna does not affect the electromagnetic field of the second antenna, which may be arranged close or proximate to the second end of the first antenna.

Alternatively and/or additionally the first antenna may be a monopole antenna, the first antenna may be a resonant antenna, the first antenna may be a quarter-wave monopole antenna etc.

Thus it is an advantage that the first antenna may be short, such as shorter than a loop antenna. When the first antenna is short, the first antenna does not require much space in the hearing aid and thus there are more options and flexibility with regards to the arrangement of the first antenna and the relative arrangement of the first antenna and the other components, such as the second antenna.

In one or more embodiments the first antenna extends around a first axis in an at least partly clockwise or at least partly counter-clockwise direction. The first axis may be an axis of the first antenna itself or an axis of the hearing aid. The first axis may be perpendicular to the faceplate. The first axis may be in a plane perpendicular to the faceplate. The first axis may intersect with the battery. The first axis may intersect the battery and be parallel with the first side of the battery and the second side of the battery. The first axis may intersect at a center point of the battery, such as at a center of mass point of the battery. The first axis may intersect the battery at a point and/or line displaced relative to the center point and/or center of mass point of the battery. At least a part of the first antenna extends in a plane, which may be termed first antenna plane, which may be parallel with the faceplate, thus a normal to the faceplate may also be a normal to the first antenna plane. The first antenna plane may extend clockwise or counter clockwise around the first axis. The first axis may be parallel with an ear to ear axis, which is normal to the faceplate. The first antenna may start by extending in an ear to ear direction.

In one or more embodiments the second antenna comprises a number of turns around a longitudinal axis. The longitudinal axis may be an axis of the second antenna. The second antenna may be a magnetic antenna for establishing an inductive connection. The second antenna may be a loop antenna, such as a magnetic loop antenna, a coil antenna, etc. A magnetic antenna, such as a magnetic loop antenna, may comprise a coil of electrically conductive material wound around a core of magnetic material. Thus the longitudinal axis may extend along a core of magnetic material of the second antenna. The longitudinal axis may extend in the center of the loops of the second antenna, and/or extend in the coil of the second antenna.

In one or more embodiments the first axis and the longitudinal axis have an angle of less than 45 degrees relative to each other. In one or more embodiments the first axis and the longitudinal axis are substantially parallel relative to each other. Thus the angle between the first axis and the longitudinal axis may be between 45 degrees and −45 degrees, such as 0 degrees. The angle between the first axis and the longitudinal axis may be between 135 degrees and 225 degrees, such as 180 degrees.

In one or more embodiments the first axis and the longitudinal axis have an angle of less than 225 degrees relative to each other, such as less than 205 degrees relative to each other, such as less than 190 degrees relative to each other.

In one or more embodiments the first axis and the longitudinal axis have an angle of more than 135 degrees relative to each other, such as more than 150 degrees relative to each other, such as more than 165 degrees relative to each other.

In one or more embodiments the printed circuit board is provided at the second end of the hearing aid. Thus it is an advantage that the printed circuit board and the receiver are arranged in opposite ends of the hearing aid for reducing the risk of electromagnetic interference between these two.

In one or more embodiments the hearing aid has a hearing aid shell having a first and a second end, where the first end of the hearing aid shell is at the first end of the hearing aid, and where the second end of the hearing aid shell is at the second end of the hearing aid. Thus the first end of the hearing aid shell may be provided, or arranged at, or placed at the first end of the hearing aid. Thus the first end of the hearing aid shell corresponds to the first end of the hearing aid. Thus the second end of the hearing aid shell may be provided, or arranged at, or placed at the second end of the hearing aid. Thus the second end of the hearing aid shell corresponds to the second end of the hearing aid. All components of the hearing aid may be arranged in the hearing aid shell.

In one or more embodiments, the first antenna has a longitudinal extension in a first direction. Thus, the first antenna may have an overall longitudinal extension in a first direction. The direction may indicate a line or path along which the first antenna is extending. For example, the overall length of the first antenna may be larger than the overall width of the first antenna indicating a longitudinal extension in the lengthwise direction.

Thus, for example, the first antenna may comprise a first antenna element extending along a plane parallel to the faceplate and to the second end of the hearing aid. The first antenna element may extend along a plane normal to the first axis. The first antenna may comprise a second antenna element extending along a first side of the battery. The second antenna element may start at the feed point of the first antenna in the printed circuit board and extend in a direction perpendicular to the faceplate. The first antenna element and the second antenna element may be substantially perpendicular to each other.

In one or more embodiments, the second antenna may have a longitudinal axis, the longitudinal axis being parallel to, or being 0/180 degrees +/−35 degrees, to an ear-to-ear axis of a user, when the hearing aid is worn in its operational position during use.

The longitudinal axis may be perpendicular, or substantially perpendicular to the direction of the first antenna element of the first antenna.

In one or more embodiments, the longitudinal axis and/or the direction of the second antenna is a direction which is 90 degrees +/−35 degrees with respect to the second end of the hearing aid, wherein the second end is adjacent a head of a user during use.

In one or more embodiments, the first antenna is configured to have a first radiation pattern and the second antenna is configured to have a second radiation pattern, the first radiation pattern being different from the second radiation pattern.

The near field pattern for the first and/or the second antenna may be a TM polarized near field. The first and/or second radiation pattern may be dominated by the E-field, so that a primary part of the overall electromagnetic field, such as more than 75%, such as more than 80%, such as more than 85%, such as more than 90% of the overall electromagnetic field, is contributed by the E-field.

An advantage of the hearing aids as disclosed herein is that an improved wireless ear-to-ear communication may be achieved for most head sizes, shapes and amount of hair. Human heads and human ears vary in size and shape and also the amount of hair varies from person to person. Hearing aids adapted for wireless communications may be susceptible to impairments of for example the ear-to-ear communication due to e.g. the head of the user. Radio waves from a hearing aid at one side may have to travel through or around the head in order to reach the hearing aid at the other ear. Therefore, the human head may be perceived as an obstacle to the ear-to-ear communication. It is an advantage that the antennas as provided in the hearing aids improve the ear-to-ear communication.

In one or more embodiments, the first antenna is configured to operate in a first frequency range, and the second antenna is configured to operate in a second frequency range. The first frequency range may comprise higher frequencies than the second frequency range.

The first antenna may be an electric antenna, and the second antenna may be a magnetic antenna.

The first antenna may be configured to operate in a first frequency range, such as at a frequency above 800 MHz, such as at a frequency above 1 GHz, such as at a frequency of 2.4 GHz, such as at a frequency between 1.5 GHz and 3 GHz, during use. Thus, the first antenna may be configured for operation in ISM frequency band. The first antenna may be any antenna capable of operating at these frequencies, and the first antenna may be a resonant antenna, such as monopole antenna, such as a dipole antenna, etc. The resonant antenna may have a length of lambda/4 or any multiple thereof, lambda being the wavelength corresponding to the emitted electromagnetic field.

The second antenna may be configured to operate at a second frequency range, such as at a frequency below 100 MHz, such as at below 30 MHz, such as below 15 MHz, during use. The second antenna may be configured to operate at a frequency range between 1 MHz and 100 MHz, such as between 1 MHz and 15 MHz, such as between 1 MHz and 30 MHz, such as between 5 MHz and 30 MHz, such as between 5 MHz and 15 MHz, such as between 10 MHz and 11 MHz, such as between 10.2 MHz and 11 MHz.

Especially, for a second antenna operating at a frequency below 10 MHz or below 100 MHz, is it advantageous that the battery is provided between the second antenna and the hearing aid electronic components, such as the printed circuit board, as the second antenna operating at such frequencies could be susceptible to noise originating from the hearing aid electronic components.

In present day communication systems, numerous different communication systems communicate at or about 2.4 GHz, and thus there is also a significant noise in the frequency range at or about 2.4 GHz. It is an advantage that for some applications for which the noise may be acceptable, for example for data communication, a first antenna, such as a first electrical antenna may be used. For other applications, in which a high noise level may impact the transmission significantly, a second antenna, such as a magnetic antenna may be used. For example, the second antenna may be used for streaming of audio.

In one or more embodiments, the first antenna is configured for data communication at a first bit rate. In one or more embodiments, the second antenna is configured for data communication at a second bit rate, the second bit rate being larger than the first bit rate, such as by a factor 10, such as by a factor 30, a factor 50, a factor 100, etc.

The second antenna may be configured for communication using magnetic induction. It is an advantage of using magnetic induction that typically low latency may be obtained. Especially when streaming audio is it of importance to keep the latency low, to avoid delays noticeable by a user.

It is a further advantage of using magnetic induction for example for communicating between a first hearing aid and a second hearing aid in a binaural system that for the low frequencies, i.e. typically below 100 MHz, and corresponding long wavelengths, the head is not considered as a significant obstacle for the electromagnetic radiation emitted by the second antenna, thus, the reduction of electromagnetic radiation due to tissue absorption is reduced when the frequency is reduced.

An in-the-ear hearing aid, the hearing aid having a first end and a second end, includes: a microphone configured to receive an audio signal; a printed circuit board comprising a processing unit configured to process the audio signal for compensating a hearing loss of a user; a receiver coupled to the printed circuit board; a battery having a first side and a second side, where the battery is located at the second end of the hearing aid; one or more wireless communication units for wireless communication; a first antenna interconnected with one of the one or more wireless communication units, where the first antenna is located at the second end of the hearing aid; and a second antenna located at the second end of the hearing aid, wherein the second antenna is located closer to the second side of the battery than the first side of the battery; wherein the printed circuit board is located closer to the first side of the battery than the second side of the battery; and wherein the first antenna is fed from the printed circuit board that is located closer to the first side of the battery than the second side, and comprises an antenna part that is located closer to the second side of the battery than the first side.

Optionally, the antenna part comprises a first end of the first antenna, or a segment that is located between the first end of the first antenna and a second end of the first antenna.

Optionally, the first antenna is fed from the printed circuit board at a first end of the first antenna, and wherein the first antenna comprises a second end.

Optionally, the second end of the first antenna is open.

Optionally, the first antenna extends around a first axis in an at least partly clockwise or at least partly counter-clockwise direction.

Optionally, the second antenna comprises a number of turns around a longitudinal axis.

Optionally, the first antenna extends around a first axis in an at least partly clockwise or at least partly counter-clockwise direction, and wherein the first axis and the longitudinal axis have an angle of less than 45 degrees relative to each other.

Optionally, the printed circuit board is located at the second end of the hearing aid.

Optionally, the hearing aid further includes a hearing aid shell having a first and a second end, and where the first end of the hearing aid shell is at the first end of the hearing aid, and where the second end of the hearing aid shell is at the second end of the hearing aid.

Optionally, the first antenna is configured for providing and/or receiving radiation in a first frequency range, and the second antenna is configured for providing and/or receiving radiation in a second frequency range.

Optionally, the first antenna is an electric antenna and the second antenna is a magnetic antenna.

Optionally, the first antenna is configured to operate at a frequency above 800 MHz.

Optionally, the second antenna is configured to operate at a frequency below 100 MHz.

Optionally, the second antenna is configured to operate at a frequency anywhere between 1 MHz and 100 MHz.

Optionally, the first antenna is configured for data communication at a first bit rate.

Optionally, the second antenna is configured for data communication at a second bit rate, the second bit rate being larger than the first bit rate.

Other aspects and features will be evident from reading the following detailed description.

BRIEF DESCRIPTION OF THE DRAWING

The above and other features and advantages will become more apparent to those of ordinary skill in the art by describing in detail exemplary embodiments thereof with reference to the attached drawings in which.

DETAILED DESCRIPTION OF THE DRAWINGS

Figure 1:
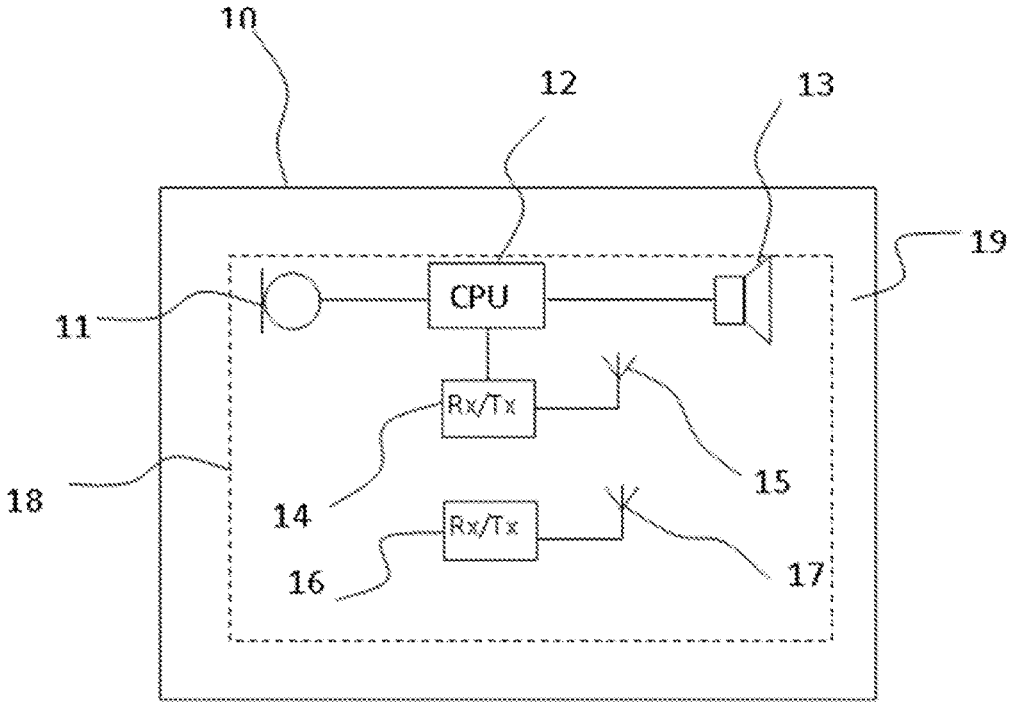
FIG. 1 shows a block-diagram of a hearing aid.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In the following, one or more embodiments are described primarily with reference to a hearing aid, such as a binaural hearing aid. It is however envisaged that the disclosed features and embodiments may be used in other types of hearing aid, or other types of hearing devices.

As used herein, the term "antenna" refers to an electrical or magnetic device which converts electric or magnetic power into radio waves. An electric antenna may comprise an electrically conductive material connected to e.g. a wireless communications unit, such as a radio chip, a receiver or a transmitter. A magnetic antenna, such as a magnetic loop antenna, may comprise a coil of electrically conductive material wound around a core of magnetic material.

FIG. 1 shows a block-diagram of a hearing aid. In FIG. 1, the hearing aid 10 comprises a microphone 11 for receiving incoming sound and converting it into an audio signal, i.e. a first audio signal. The first audio signal is provided to a signal processor 12 for processing the first audio signal into a second audio signal compensating a hearing loss of a user of the hearing aid. A receiver is connected to an output of the signal processor 12 for converting the second audio signal into an output sound signal, e.g. a signal modified to compensate for a user's hearing impairment, and provides the output sound to a speaker 13. Thus, the hearing instrument signal processor 12 may comprise elements such as amplifiers, compressors and noise reduction systems etc. The hearing aid may further have a feedback loop for optimizing the output signal. The hearing aid has one or more wireless communication units 14,16 (e.g. a transceiver) for wireless communication, each interconnected with an antenna 15, 17 for emission and reception of an electromagnetic field. The wireless communication units 14, 16 may connect to the hearing aid signal processor 12 and antennas 15, 17 for communicating with external devices, or with another hearing aid, located in another ear, in a binaural hearing aid system. The signal processor 12, the one or more wireless communication units 14,16, the speaker 13 and the antennas 15, 17 may be provided in a hearing aid shell 18.

The first antenna 15 is connected to a first wireless communication unit 14, such as a transceiver. The second antenna 17 is connected to a second wireless communication unit 16, such as a transceiver, different from the first wireless communication unit 14.

Like reference numbers in FIG. 1 and the other figures correspond to the same features.

Figure 2:
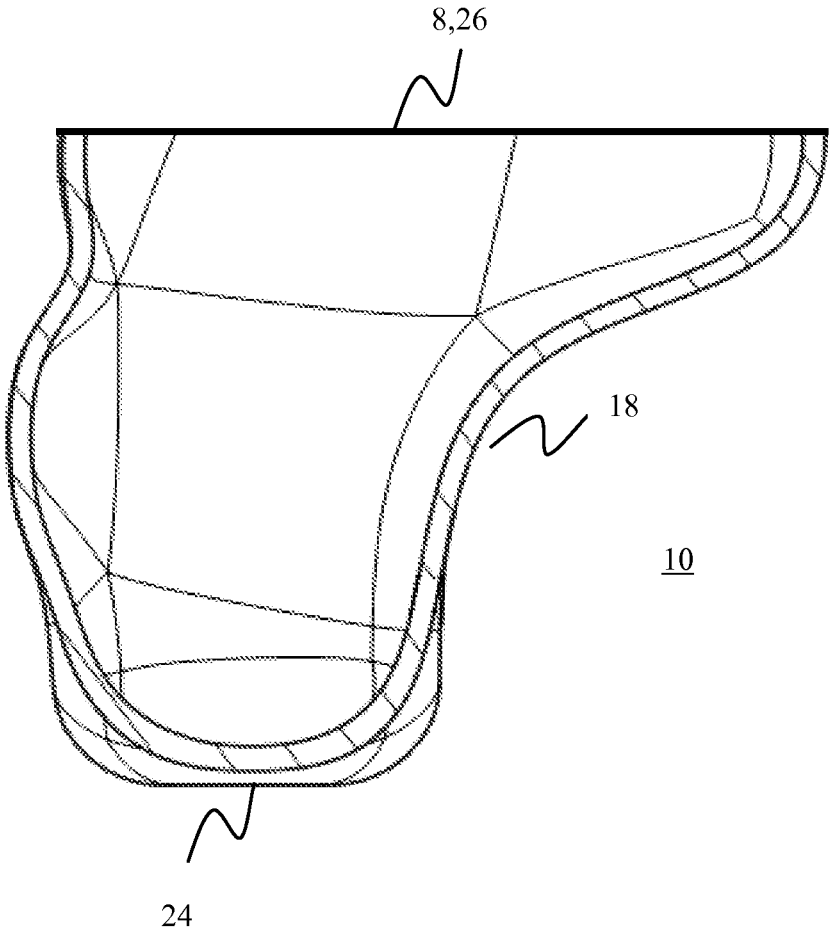
FIG. 2 schematically illustrates an exemplary hearing aid shell of a hearing aid.

FIG. 2 schematically illustrates an exemplary hearing aid shell 18 of a hearing aid 10. The hearing aid 10 and hearing aid shell has a first end 24 configured to point towards the inner ear canal and tympanic membrane of the user when in use, and a second end 26 configured to point towards the surroundings when in use. A faceplate 8 is arranged at the second end 26. The hearing aid 10 and hearing aid shell 18 are configured to comprise a battery (not shown) for supplying power to the electronic components, including the one or more wireless communication units (not shown), see FIG. 1, the signal processor (not shown) see FIG. 1 etc., of the hearing aid. The hearing aid furthermore comprises a first antenna (not shown) see FIG. 1, and a second antenna (not shown) see FIG. 1.

Like reference numbers in FIG. 2 and the other figures correspond to the same features.

Figure 3:
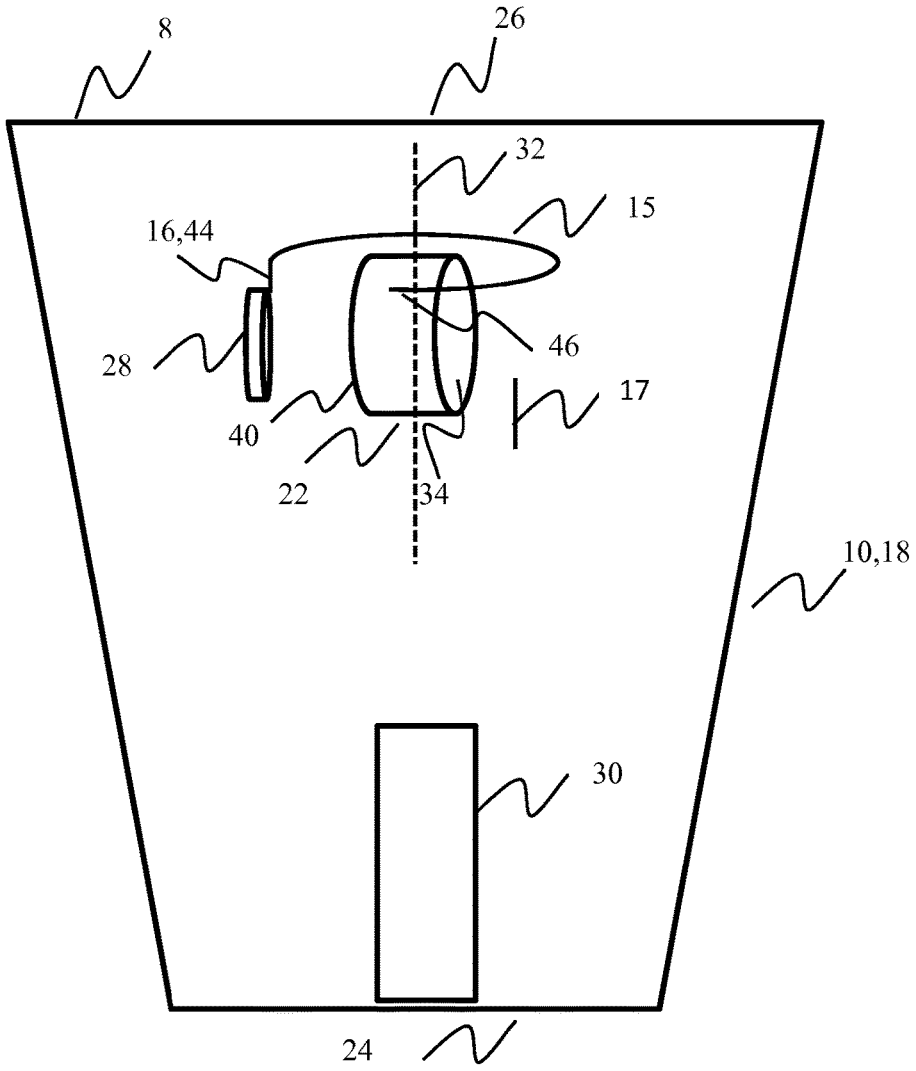
FIG. 3 schematically illustrates an exemplary hearing aid shell of a hearing aid.

FIG. 3 schematically illustrates an exemplary hearing aid shell 18 of a hearing aid 10. The first antenna 15 is provided within the hearing aid shell 18. The first antenna 15 is an electric antenna, such as a monopole or dipole electric antenna, such as a resonant antenna. The first antenna 15 may be provided on a printed circuit board 28. The first antenna 15 may be fed from the printed circuit board, or have its feed point 16 at the printed circuit board or have its connection to the transmission line at the printed circuit board. The printed circuit board 28 is provided at the first side 40 of the battery 22.

The first antenna 15 is feed 16 at or from the printed circuit board 28 at the first side 40 of the battery 22 and extends to the second side 34 of the battery 22.

The printed circuit board 28 may be a flexible printed circuit board 28. Further electronic components may be provided on the printed circuit board 28.

The second antenna 17 is provided at the second side 34 of the battery 22.

The first antenna 15 is fed from the printed circuit board 28 at a first end 44 of the antenna 15. The first antenna 15 comprises a second end 46, and the second end 46 of the first antenna 15 may be an open end. The first antenna 15 extends clockwise around a first axis 32.

Typically, the second antenna 17 is a magnetic antenna for establishing an inductive connection, and the second antenna may be a loop antenna, such as a magnetic loop antenna, a coil antenna, etc.

A receiver 30 is provided at the first end 24 of the hearing aid 10 and shell 18.

Like reference numbers in FIG. 3 and the other figures correspond to the same features.

Figure 4:
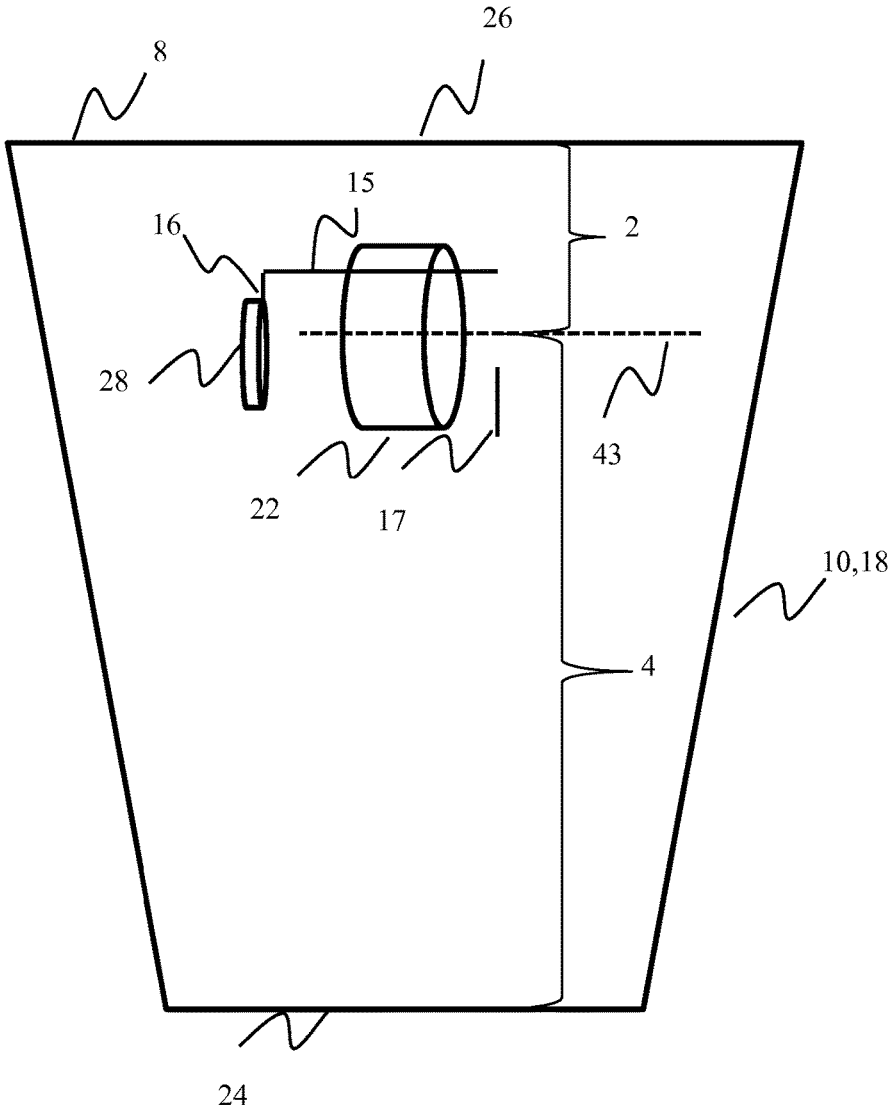
FIG. 4 schematically illustrates an exemplary hearing aid shell of a hearing aid.

FIG. 4 schematically illustrates an exemplary hearing aid shell 18 of a hearing 10. It is seen that the battery 22 is provided closer to a second end 26 of the hearing aid shell 18 than to a first end 24 of the hearing aid shell 18. Thus, a first distance 2 from the second end 26 to the center axis 43 of the battery is shorter than a second distance 4 from the first end 24 to the center axis 43 of the battery.

In some embodiments, the battery is a round flat type battery, such as a button cell type battery or coin cell type battery, and the center axis of the battery is an axis through a center of the battery from a first flat side of the battery to the other second flat side of the battery. The center axis of the battery may be parallel, such as 180 degrees +/−15 degrees, such as 180 degrees +/−35 degrees, to the first end of the hearing aid and/or to the second end of the hearing aid shell.

Like reference numbers in FIG. 4 and the other figures correspond to the same features.

Figure 5:
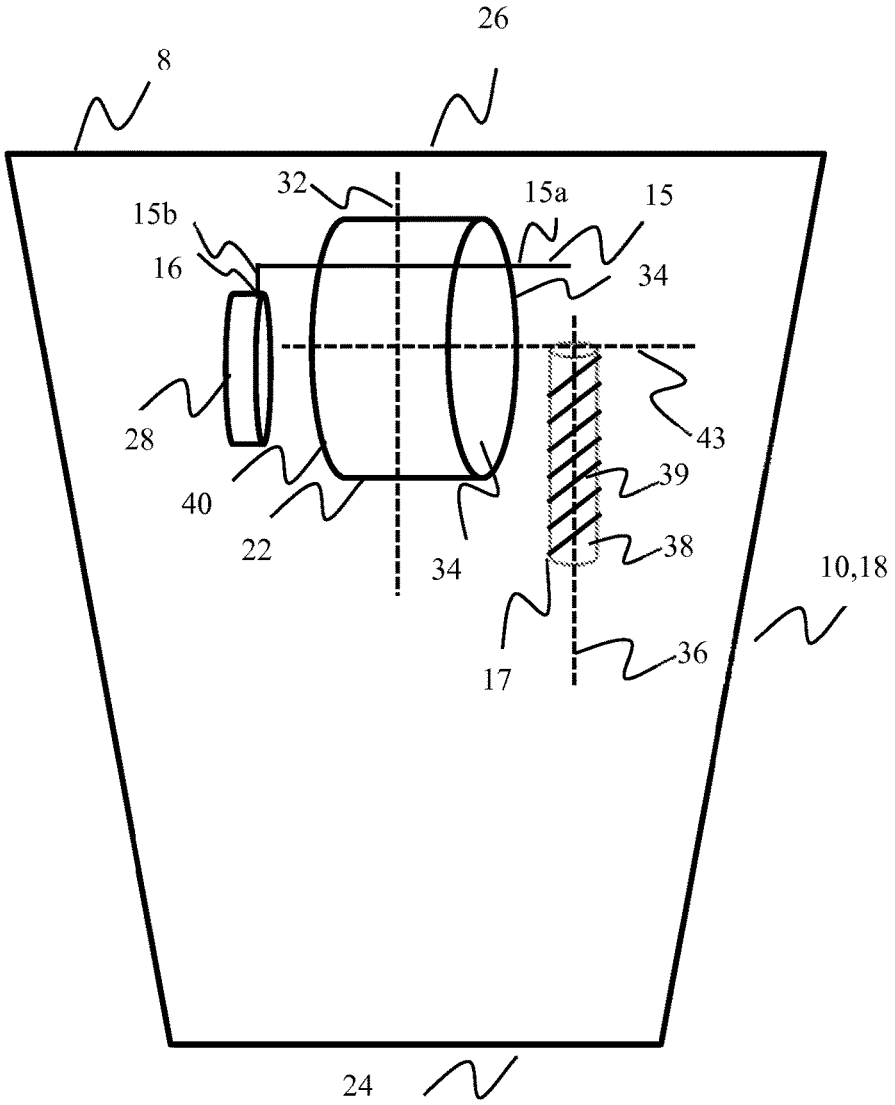
FIG. 5 schematically illustrates an exemplary embodiment of the first antenna and second antenna.

FIG. 5 schematically illustrates an exemplary embodiment of the first antenna and second antenna. The first antenna 15 extends around a first axis 32 in an at least partly clockwise or at least partly counter-clockwise direction. The first antenna 15 may comprise a first antenna element 15*a* extending around the first axis 32 and/or extending along with or parallel to the center axis 43 of the battery 22. The first antenna 15 may comprise a second antenna element 15*b* extending at least partly along a first side 34 of the battery 22. The second antenna element 15*b* may extend parallel with the first axis 32 and perpendicular to the first antenna element 15*a*. The second antenna element 15*b* may extend from the feeding point 16 at the printed circuit board 28 to a point where the first antenna element 15*a* starts. The angle between the first antenna element 15*a* and the second antenna element 15*b* may be about 90 degrees, thus the first antenna element 15*a* and the second antenna element 15*b* may be perpendicular to each other. The currents and thereby the electromagnetic field of the first antenna 15 may be largest at the feed point 16 and thus at the second antenna element 15*b*. The currents and thereby the electromagnetic field of the first antenna 15 may be zero or lowest at the second end of the first antenna, i.e. at the end of the first antenna element 15*a* closest to the second antenna.

In one or more embodiments, the second antenna 17 may have a longitudinal axis 36, the longitudinal axis being parallel to, or substantially parallel to, or being 0/180 degrees +/−35 degrees to the first axis 32 and perpendicular to the direction of the first antenna element 15*a* of the first antenna 15.

In one or more embodiments, the longitudinal axis 36 and/or the direction of the second antenna is a direction which is 90 degrees +/−35 degrees with respect to the second end 26 of the hearing aid 10.

The second antenna 17 is a magnetic loop antenna which has a longitudinal axis 36. It is seen that the center axis 43 of the battery 22 is orthogonal, such as orthogonal +/−15 degrees, such as orthogonal +/−35 degrees, with the longitudinal axis 36 of the magnetic loop antenna 17.

Typically, the second antenna 17 comprises a magnetic core 38, in the form of a rod of a magnetic material, and windings 39 of an electrical conductor wound around the magnetic core 38. The longitudinal axis 36 of the second antenna 17 is the longitudinal axis of the magnetic core 38.

The second antenna 17 may be provided so that the rod 38 of magnetic material is provided longitudinal in the hearing aid shell 18, thus so that the second antenna 17 has a longitudinal direction orthogonal to first end 24 and/or the second end 26 of the hearing aid shell 18. The longitudinal axis 36 may thus form an angle with the transversal sides, i.e. the first end 24 and the second end 24, of the hearing aid shell 18 of 90 degrees, such as of 90 degrees +/−15 degrees, such as of 90 degrees +/−35 degrees. The second antenna 17 may primarily radiate through the first 24 end and/or the second 26 of the shell 18, i.e. through the transverse surfaces. The magnetic core 38 and the windings 39 may be provided in a housing (not shown), such as a housing shielding longitudinal parts of the second antenna 17.

A shadow effect of the battery 22 may be provided in the hearing aid or shell for shielding the first 15 and the second antenna 17 from each other. At one side of the battery 22, an antenna will be shielded by the battery from influence from an antenna at the other side of the battery 22. For example, the second antenna 17 is shielded from the electromagnetic field of the first antenna 15 by the battery 22. As the first antenna 15 is fed at the printed circuit board 28 at the feed point 16, the currents, and thus the electromagnetic field, of the first antenna 15 is largest here, which is at the first side 40 of the battery 22. Thus, if the second antenna 17 is provided behind the battery 22, i.e. at the side opposite the side of the feed point 16 of the first antenna, i.e. at the second side 34 of the battery 22, for example in the shadow region, the second antenna 17 is shielded from the first antenna 15 by the battery 22.

Like reference numbers in FIG. 5 and the other figures correspond to the same features.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

REFERENCE LIST

8 faceplate
10 hearing aid
11 microphone
12 signal processor
13 speaker
14,16 one or more wireless communication units,
15 first antenna
15*a* first antenna element
15*b* second antenna element
17 second antenna
18 hearing aid shell
22 battery
21 center axis of battery
24 first end of the hearing aid/shell
26 second end of the hearing aid/shell
28 printed circuit board
30 receiver
32 first axis
34 second side of battery
36 longitudinal axis
38 magnetic core of second antenna
39 windings of second antenna
40 first side of battery
43 centre axis of battery
44 first end of first antenna
46 second end of first antenna

The invention claimed is:

1. An in-the-ear hearing aid, the hearing aid having a first end and a second end, the hearing aid comprising:
- a microphone configured to receive an audio signal;
- a printed circuit board comprising a processing unit configured to process the audio signal for compensating a hearing loss of a user;
- a receiver coupled to the printed circuit board;
- a battery having a first side and a second side, where the battery is located at the second end of the hearing aid;
- one or more wireless communication units for wireless communication;
- a first antenna interconnected with one of the one or more wireless communication units, where the first antenna is located at the second end of the hearing aid; and
- a second antenna located at the second end of the hearing aid,
- wherein the second antenna is located closer to the second side of the battery than the first side of the battery;
- wherein the printed circuit board is located closer to the first side of the battery than the second side of the battery; and
- wherein the first antenna is fed from the printed circuit board that is located closer to the first side of the battery than the second side, and comprises an antenna part that is located closer to the second side of the battery than the first side.

2. The hearing aid according to claim 1, wherein the antenna part comprises a first end of the first antenna, or a segment that is located between the first end of the first antenna and a second end of the first antenna.

3. The hearing aid according to claim 1, wherein the first antenna is fed from the printed circuit board at a first end of the first antenna, and wherein the first antenna comprises a second end.

4. The hearing aid according to claim 3, wherein the second end of the first antenna is open.

5. The hearing aid according to claim 1, wherein the first antenna extends around a first axis in an at least partly clockwise or at least partly counter-clockwise direction.

6. The hearing aid according to claim 1, wherein the second antenna comprises a number of turns around a longitudinal axis.

7. The hearing aid according to claim 6, wherein the first antenna extends around a first axis in an at least partly clockwise or at least partly counter-clockwise direction, and wherein the first axis and the longitudinal axis have an angle of less than 45 degrees relative to each other.

8. The hearing aid according to claim 1, wherein the printed circuit board is located at the second end of the hearing aid.

9. The hearing aid according to claim 1, further comprising a hearing aid shell having a first and a second end, and where the first end of the hearing aid shell is at the first end of the hearing aid, and where the second end of the hearing aid shell is at the second end of the hearing aid.

10. The hearing aid according to claim 1, wherein the first antenna is configured for providing and/or receiving radiation in a first frequency range, and the second antenna is configured for providing and/or receiving radiation in a second frequency range.

11. The hearing aid according to claim 1, wherein the first antenna is an electric antenna and the second antenna is a magnetic antenna.

12. The hearing aid according to claim 1, wherein the first antenna is configured to operate at a frequency above 800 MHz.

13. The hearing aid according to claim 1, wherein the second antenna is configured to operate at a frequency below 100 MHz.

14. The hearing aid according to claim 1, wherein the second antenna is configured to operate at a frequency anywhere between 1 MHz and 100 MHz.

15. The hearing aid according to claim 1, wherein the first antenna is configured for data communication at a first bit rate.

16. The hearing aid according to claim 15, wherein the second antenna is configured for data communication at a second bit rate, the second bit rate being larger than the first bit rate.

* * * * *